US010401086B2

(12) United States Patent
Pucciani et al.

(10) Patent No.: US 10,401,086 B2
(45) Date of Patent: Sep. 3, 2019

(54) AIR MANIFOLD FOR DRYING A CONTAINER

(71) Applicant: Illinois Tool Works Inc., Glenview, IL (US)

(72) Inventors: Allen Steve Pucciani, Beavercreek, OH (US); Jeem E. Newland, III, Franklin, OH (US)

(73) Assignee: Illinois Tool Works Inc., Glenview, IL (US)

( * ) Notice: Subject to any disclaimer, the term of this patent is extended or adjusted under 35 U.S.C. 154(b) by 546 days.

(21) Appl. No.: 14/085,347

(22) Filed: Nov. 20, 2013

(65) Prior Publication Data

US 2014/0199935 A1 Jul. 17, 2014

Related U.S. Application Data

(60) Provisional application No. 61/752,678, filed on Jan. 15, 2013.

(51) Int. Cl.
*F26B 15/18* (2006.01)
*F26B 21/00* (2006.01)

(52) U.S. Cl.
CPC ..... *F26B 21/004* (2013.01); *F26B 15/18* (2013.01); *Y10T 29/49826* (2015.01)

(58) Field of Classification Search
CPC ..... B60S 3/002; F16L 3/16
USPC ..... 454/305, 49; 34/105, 232
See application file for complete search history.

(56) References Cited

U.S. PATENT DOCUMENTS 1,163,277 A 12/1915 Staggers
1,224,560 A * 5/1917 Needham ..... F24F 13/06 239/263.2
1,389,004 A 8/1921 Johnston
1,396,210 A 11/1921 Humphrey
1,801,171 A 4/1931 Mueller
1,976,797 A 10/1934 Naylor
2,011,433 A 8/1935 Blagg
2,041,706 A * 5/1936 Hahn ..... F23D 14/105 239/553
2,092,358 A 9/1937 Robertson
2,132,303 A * 10/1938 Lathrop ..... F26B 21/004 134/144
2,157,131 A * 5/1939 Hothersall ..... F26B 15/18 34/105
2,166,300 A 7/1939 Komar
(Continued)

FOREIGN PATENT DOCUMENTS

FR 2497935 A1 * 7/1982 ..... F26B 15/18
GB 2276708 * 5/1994

OTHER PUBLICATIONS

Machine translation of FR 2497935.*
(Continued)

*Primary Examiner* — Avinash A Savani
*Assistant Examiner* — Martha M Becton
(74) *Attorney, Agent, or Firm* — McAndrews, Held & Malloy, Ltd.

(57) ABSTRACT

A system for drying a container includes an air manifold. The air manifold includes a main body having multiple outlets and multiple arms. Each arm is coupled to a respective outlet, is disposed in a fixed position relative to the main body, and is configured to direct air received from the main body toward the container.

20 Claims, 9 Drawing Sheets

(56) References Cited

U.S. PATENT DOCUMENTS 2,334,854 A * 11/1943 Zademach ..... F26B 15/18 34/222
2,374,574 A 4/1945 Adams, Jr.
2,419,453 A 4/1947 Kocevar
2,514,504 A 7/1950 Moline
2,683,315 A 7/1954 Bowman
2,814,508 A 11/1957 Seamark
2,920,178 A 1/1960 Schossow
3,076,668 A 2/1963 Famely
3,167,333 A 1/1965 Hall
3,272,176 A 9/1966 Saydlowski
3,309,835 A * 3/1967 Peppler ..... B65B 53/063 34/225
3,503,554 A 3/1970 Clifton
3,510,065 A 5/1970 Gigantino
3,521,913 A 7/1970 Verhein
3,568,238 A * 3/1971 Fischer ..... F26B 15/18 15/309.2
3,602,531 A 8/1971 Patry
3,726,020 A * 4/1973 Lee, Jr. ..... F26B 15/18 134/152
3,760,430 A 9/1973 Brenden
3,974,091 A 8/1976 Parker
4,270,702 A 6/1981 Nicholson
4,292,745 A * 10/1981 Caratsch ..... F26B 13/104 226/196.1
4,322,384 A 3/1982 Sutton
4,332,198 A * 6/1982 Schmoeger ..... B41F 23/06 101/424.2
4,349,399 A * 9/1982 Obrist ..... B65B 7/2885 156/497
4,386,708 A * 6/1983 Sieverin ..... B07C 5/3408 209/549
4,515,313 A 5/1985 Cavanagh
4,823,771 A 4/1989 Menning
4,845,860 A * 7/1989 Jackson ..... F26B 17/101 34/227
4,852,271 A * 8/1989 Heckman ..... F26B 15/18 34/105
4,930,705 A 6/1990 Broerman
4,991,316 A * 2/1991 Crotts ..... B60S 3/002 34/232
5,015,372 A 5/1991 Mercer
5,029,879 A 7/1991 Strang, Sr.
5,060,689 A 10/1991 Csaszar
5,064,118 A 11/1991 Lauricella
5,361,855 A 11/1994 Schuermann
5,427,317 A 6/1995 Huttlin
5,487,571 A 1/1996 Robertson
5,494,529 A * 2/1996 Ciccarelli ..... B08B 3/022 134/15
5,507,538 A 4/1996 Phillips
5,575,423 A 11/1996 Yuen
5,636,878 A 6/1997 Millward
5,657,928 A 8/1997 Jian
5,680,993 A 10/1997 McCracken
5,725,008 A 3/1998 Johnson
5,755,043 A * 5/1998 Belanger ..... B60S 3/002 15/312.1
5,894,938 A * 4/1999 Ichise ..... B07C 5/02 209/559
5,983,923 A 11/1999 Hobbs
6,000,420 A 12/1999 Nicholson
6,024,028 A * 2/2000 Simonen ..... F23G 7/04 110/182.5
6,038,992 A 3/2000 Smith
6,065,693 A 5/2000 Lukas
6,113,047 A 9/2000 Wung
6,296,123 B1 * 10/2001 Zakeri ..... B07C 5/3408 209/522
6,450,879 B1 9/2002 Suen
6,769,721 B2 8/2004 Guest
6,840,702 B2 1/2005 Ko
6,961,638 B2 * 11/2005 Ouellette ..... B07C 5/3416 198/395
7,081,127 B1 7/2006 Lee
7,204,733 B2 4/2007 Nash
7,461,797 B2 12/2008 Bhat
7,563,322 B2 7/2009 Loth
7,922,139 B2 4/2011 Dittmer
8,074,372 B2 * 12/2011 Pucciani ..... F26B 15/18 34/222
8,382,013 B2 2/2013 Pucciani
8,444,188 B2 * 5/2013 Pucciani ..... F16L 21/002 285/148.18
8,528,232 B1 * 9/2013 Ennis ..... B60S 3/002 134/12
8,707,989 B2 4/2014 Pucciani
8,960,572 B2 * 2/2015 Pucciani ..... B21D 53/06 239/556
9,452,450 B2 * 9/2016 Frost ..... B07C 5/367
2003/0061725 A1 * 4/2003 Riley ..... F26B 21/004 34/236
2003/0105550 A1 * 6/2003 Ouellette ..... B07C 5/3408 700/213
2005/0134045 A1 6/2005 Mohan
2005/0156429 A1 7/2005 Muckenschnabel
2005/0199293 A1 9/2005 Fulcher
2005/0248151 A1 11/2005 Connell
2006/0163871 A1 7/2006 VanPelt
2007/0277548 A1 12/2007 Stefani
2008/0245903 A1 10/2008 Loth
2010/0120350 A1 5/2010 Pucciani
2011/0048557 A1 * 3/2011 Pucciani ..... F16L 3/16 137/561 A
2012/0031818 A1 * 2/2012 Frost ..... B07C 5/367 209/555
2012/0291308 A1 * 11/2012 McElroy ..... F26B 21/004 34/666

OTHER PUBLICATIONS

Air Control Industries, www.aircontrolindustries.com, DRI-Line Series Can Drying Tunnels, (2011).
Air Control Industries, www.aircontrolindustries.com, DRI-Line Series—Other Drying Methods, (2011).
Air Control Industries, www.aircontrolindustries.com, dri-line options—Cap Dryers, (2009).
Sonic Air Systems, Component Specification Sheet—Quick Release Brackets, Apr. 4, 2006, Rev. A.
Sonic Air Systems, Sonic Installation Manual Air Knife, Sonic Air Systems, Inc., Copyright 2003. www.sonicairsystems.com_manual_airknife.

* cited by examiner

AIR MANIFOLD FOR DRYING A CONTAINER

CROSS-REFERENCE TO RELATED APPLICATION

This application claims priority from and the benefit of U.S. Provisional Application Ser. No. 61/752,678, entitled "AIR MANIFOLD FOR DRYING A CONTAINER," filed Jan. 15, 2013, which is hereby incorporated by reference in its entirety for all purposes.

BACKGROUND

The present disclosure relates generally to fluid discharge devices and, more particularly, to an air manifold for drying a container.

A variety of systems transfer fluids from a fluid supply source to one or more fluid discharge devices. In some systems, an arrangement of fluid conduits, which may include metal pipes, plastic pipes, and/or hoses, may provide a flow path for routing, channeling, or otherwise delivering a fluid from a fluid supply source to a fluid discharge device, such as an air manifold. In the case of an air manifold, air received via an inlet may be pressurized and directed through flexible hoses to a series of nozzles. The output of the nozzles may be used for a variety of applications, such as drying and removing moisture from objects, removing dust or debris, cooling, surface preparation, and so forth. As may be appreciated, the flexible hoses may not direct air in a desired direction. Moreover, the flexible hoses may become worn and/or broken, and may inefficiently direct air.

BRIEF DESCRIPTION

Certain aspects of embodiments disclosed herein by way of example are summarized below. It should be understood that these aspects are presented merely to provide the reader with a brief summary of certain forms an invention disclosed and/or claimed herein might take, and that these aspects are not intended to limit the scope of any invention disclosed and/or claimed herein. Indeed, any invention disclosed and/or claimed herein may encompass a variety of aspects that may not be set forth below.

In one embodiment, a system for drying a container includes an air manifold. The air manifold includes a main body having multiple outlets and multiple arms. Each arm is coupled to a respective outlet, is disposed in a fixed position relative to the main body, and is configured to direct air received from the main body toward the container.

In another embodiment, a system for drying a container includes an air manifold. The air manifold includes a main body having multiple outlets and multiple arms. Each arm is coupled to a respective outlet, is disposed in a fixed position relative to the main body, and is configured to direct air received from the main body toward the container. Moreover, each arm is formed from a metal tube having a first end bent into a flared shape, and a second end welded to the respective outlet.

In a further embodiment, a method includes bending a first end of a first metal tube to form a flared nozzle. The method also includes welding a second end of the first metal tube to an outlet of a main body of an air manifold.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments will be described below. These described embodiments are provided only by way of example, and do not limit the scope of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments described below, the articles "a," "an," and "the" are intended to mean that there are one or more of the elements. The terms "comprising," "including," and "having" are intended to be inclusive and mean that there may be additional elements other than the listed elements. Moreover, while the term "exemplary" may be used herein in connection to certain examples of aspects or embodiments of the presently disclosed subject matter, it will be appreciated that these examples are illustrative in nature and that the term "exemplary" is not used herein to denote any preference or requirement with respect to a disclosed aspect or embodiment. Additionally, it should be understood that references to "one embodiment," "an embodiment," "some embodiments," and the like are not intended to be interpreted as excluding the existence of additional embodiments that also incorporate the disclosed features.

Figure 1:
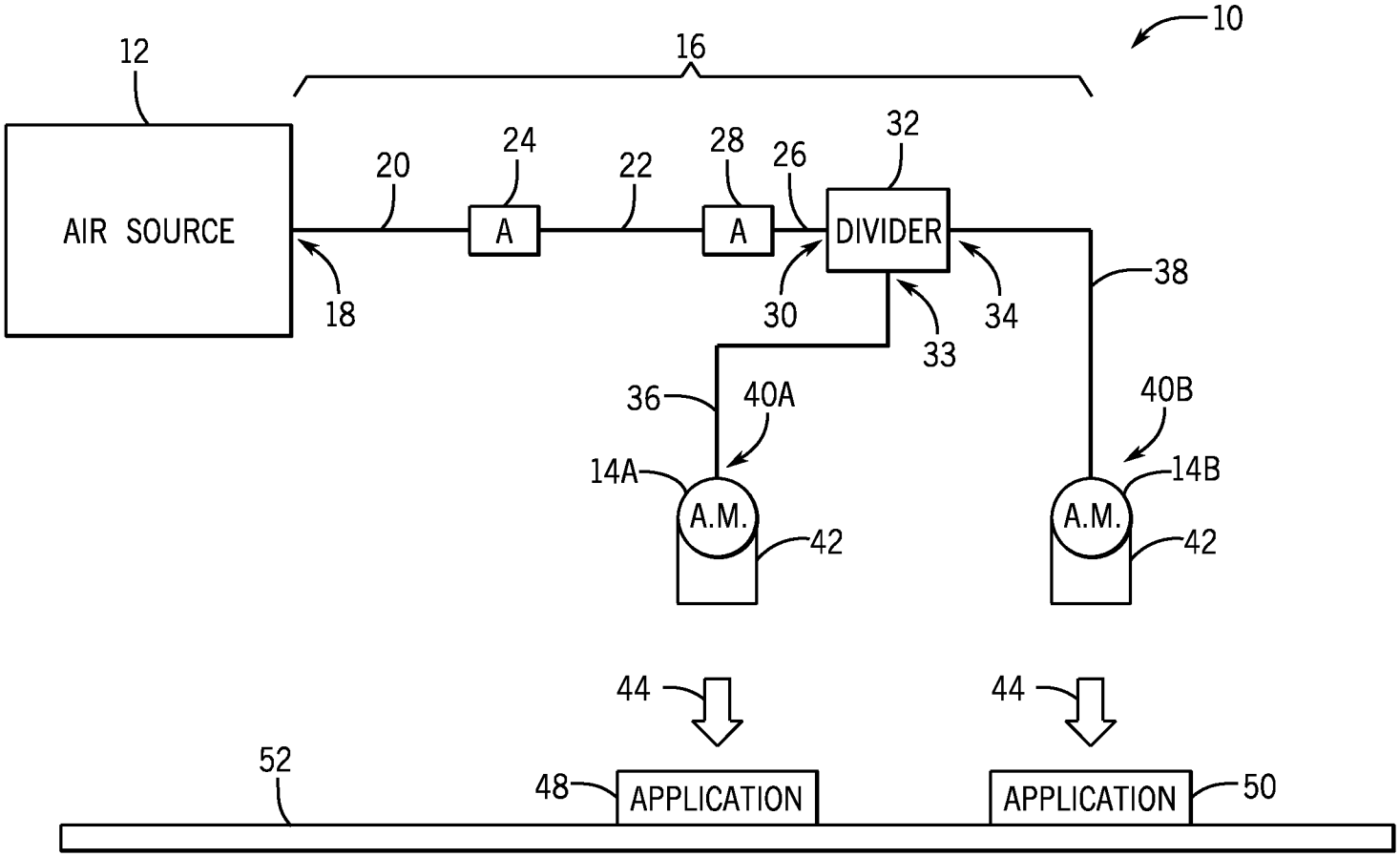
FIG. 1 is a simplified block diagram depicting a fluid-based system that includes one or more air manifolds having air delivery conduits disposed in a fixed position, in accordance with embodiments of the present disclosure.

Turning now to the drawings, FIG. 1 illustrates a processing system 10 that may incorporate one or more aspects of the presently disclosed techniques. The processing system 10 includes an air supply source 12 that delivers a fluid (e.g., air) to air manifolds 14A and 14B along a flow path 16. In the illustrated embodiment, the flow path 16 includes the fluid conduits 20, 22, 26, 36, and 38, the adapters 24 and 28, and the divider 32.

In the presently illustrated system 10, the air supply source 12 may include a high flow centrifugal blower ("air blower") which, in some embodiments, may include a supercharger and motor configuration. In one embodiment, the operating characteristics of the air blower may provide an air flow having a pressure of between approximately 1-10 pounds per square inch (psi) and having a flow rate of between approximately 50-2000 cubic feet per minute (CFM) or more specifically, between approximately 150 to 1500 CFM. In some embodiments, the air blower may be housed within an enclosure. The air blower may be separated from the air manifolds 14A and 14B by a distance of 10, 20, 30, 40, 50, 100, or 200 feet or more. As such, the flow path 16 is configured to provide a path through which air provided by the air blower may be routed and ultimately delivered to the air manifolds 14A and 14B.

The air supply source 12 includes an outlet 18 coupled to the fluid conduit 20 that defines a first portion of the flow path 16. The fluid conduit 20 is coupled to the downstream fluid conduit 22 using the first adapter 24. In certain embodiments, the fluid conduit 20 may be a hose, such as a flexible hose, and the fluid conduit 22 may be a pipe, such as a stainless steel pipe or a polyvinyl chloride (PVC) pipe. In such embodiments, the adapter 24 may be configured to provide an interface for coupling the hose 20 and pipe 22. For instance, the adapter 24 may include a first adapter end configured to couple to the hose 18, and a second adapter end configured to couple to the pipe 20. In this manner, the hose 20, adapter 24, and pipe 22 are fluidly coupled, thereby allowing air discharged from the outlet 18 of the air supply source 12 to flow from the hose 20 into the pipe 22.

The flow path 16 continues to the distal end of the pipe 22, which may be coupled to another hose 26 by way of the second adapter 28 that may be similar in design to the first adapter 24. Thus, by way of the adapters 24 and 28, the air flow from the air supply source 12 is received by an inlet 30 of the flow divider 32. The flow divider 32 is configured to distribute or split the air flow to multiple outlets 33 and 34. Additional fluid conduits 36 and 38 respectively couple the outlets 33 and 34 to the air manifolds 14A and 14B. In the illustrated embodiment, the air manifolds 14A and 14B may each include an inlet (40A and 40B) configured for a hose connection, and the fluid conduits 36 and 38 may thus be provided as hoses, such as flexible hoses. In other embodiments, a pipe may be disposed between the divider 32 and one of the air manifolds 14A or 14B, whereby adapters similar to the above-discussed adapters 24 or 28 are coupled to each end of the pipe to facilitate a fluid connection between hoses extending from an outlet (e.g., 33 or 34) of the divider 32 and from an inlet (e.g., 40A or 40B) of one of the air manifolds (e.g., 14A or 14B). In some embodiments, the system 10 may include only a single air manifold (e.g., 14A) and thus may not include a divider 32. In such embodiments, the fluid conduit 26 may be coupled directly to the air manifold 14A.

As will be discussed further below, the air manifold 14A may include a main body or housing that defines a plenum or fluid cavity for receiving an air flow via the inlet 40A. In certain embodiments, the air manifold 14A may be formed of materials including aluminum, stainless steel, plastic or composite materials, or some combination thereof. In some embodiments, the main body may be generally cylindrical in shape and may include one or more openings which provide a path for air to flow into air delivery conduits 42 coupled to the main body of the air manifold 14A. In other embodiments, the main body may be a boxed shape housing that includes one or more openings to provide a path for air to flow into respective air delivery conduits 42 coupled to the main body of the air manifold 14A.

In operation, the fluid cavity defined by the main body of the air manifold 14A may pressurize and discharge air received via the inlet 40A through the air delivery conduits 42, as indicated by the output air flow 44. Accordingly, the air flow 44 exiting the air delivery conduits 42 may have a velocity that is greater than the velocity of the air flow entering via the inlet 40A. As may be appreciated, the air manifold 14B may be constructed in a manner that is similar to the air manifold 14A and, thus may operate in a similar manner. Further, while only two outlets 33 and 34 are shown in FIG. 1, it may be appreciated that the flow divider 32 may be configured to provide any suitable number of outlets, and may provide flow paths to any suitable number of devices, such as additional air manifolds, air knives, flow dividers, and so forth.

As shown in FIG. 1, the air flows 44 exiting the respective air delivery conduits 42 of each of the air manifolds 14A and 14B may be directed towards applications 48 and 50, respectively, of the processing system 10. For instance, the applications 48 and 50 may be transported through the system 10 along a conveyor belt 52 or some other suitable type of transport mechanism. As may be appreciated, the application represented by the system 10 may utilize the air flows 44 provided by the air manifolds 14A and 14B, respectively, for a variety of functions, including but not limited to drying products, removing dust or debris, coating control, cooling, leak detection, surface impregnation, corrosion prevention, and so forth. For instance, in certain embodiments, the system 10 may be a system for drying food or beverage containers, such as cans or bottles (e.g., caps of bottles), or may be a system for removing dust and other debris from sensitive electronic products, such as printed circuit boards (PCBs) or the like. In addition, some embodiments of the system 10 may also utilize the air flows 44 to clean and/or remove debris from the conveyer belt 52.

The air delivery conduits 42 of the air manifold 14A may include arms disposed in a fixed position to facilitate accurate delivery of air through the air delivery conduits 42. For example, the arms may be positioned relative to the main body of the air manifold 14A during manufacturing, or during assembly, and may remain in such a position during operation of the air manifold 14A. Furthermore, the arms may be manufactured from metal to block inadvertent adjustment of the arms to an incorrect position. Accordingly, the air manifold 14A may accurately deliver air through the air delivery conduits 42. As may be appreciated, the fixed position of the arms may be a position that is calculated to provide air to dry containers of varying size.

Figure 2:
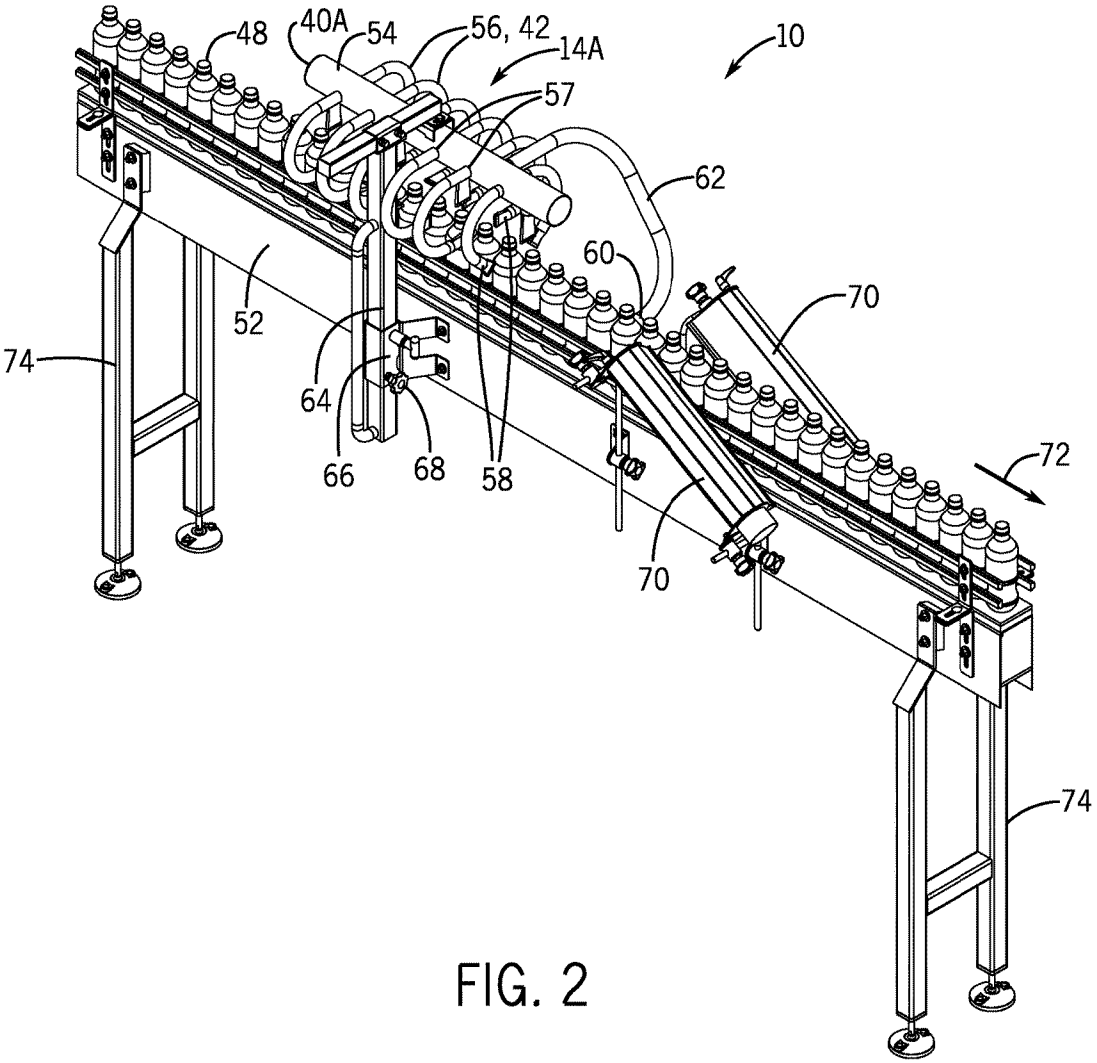
FIG. 2 is a perspective view of an embodiment of an air manifold having air delivery conduits disposed in a fixed position.

FIG. 2 is a perspective view of an embodiment of the air manifold 14A having air delivery conduits 42 disposed in a fixed position (e.g., rigid position). The air manifold 14A includes a main body 54 having the inlet 40A configured to receive air from the air source 12. As illustrated, the main body 54 has a generally cylindrical shape. For example, the main body 54 may be formed from a metal tube. Arms 56 (i.e., air delivery conduits 42) are coupled to the main body 54 and configured to receive air from the main body 54, and to direct the air toward the application 48 (e.g., containers moving on the conveyor belt 52). The arms 56 are disposed in a fixed position such that air is delivered from the main body 54 to a precise location. For example, the arms 56 may be configured to deliver air to remove water off caps of bottles (e.g., sides of caps, tops of caps, etc.), out of crevices on or under caps, and/or off necks of bottles.

As illustrated, the arms 56 are attached to outlets 57 of the main body 54. In certain embodiments, the arms 56 may be welded to the outlets 57 of the main body 54. In such embodiments, the main body 54 and the arms 56 may be formed from a metal (e.g., stainless steel), a metal alloy, or any suitable material. The arms 56 include a nozzle 58, such as the illustrated flared nozzle, to direct air toward the containers. In certain embodiments, the nozzle 58 may be configured such that during operation, the nozzle 58 is positioned within approximately 0.25 inches to 4.00 inches from a bottle and/or a cap. For example, in some embodiments, the nozzle 58 may be positioned within approximately 1.00 inches from a bottle. Moreover, in certain embodiments, the nozzle 58 may be configured to provide an air flow having a flow rate of between approximately 250 to 750 CFM. For example, in some embodiments, the nozzle 58 may be configured to provide an air flow having a flow rate of approximately 500 CFM.

The system 10 also includes a blowout device 60 configured to blow empty bottles off the conveyor belt 52. As may be appreciated, the blowout device 60 may include a flared nozzle to direct air toward the conveyor belt 52. Furthermore, the blowout device 60 is coupled to the conveyor belt 52 in a fixed position (e.g., mounted to the conveyor belt 52). A hose 62 couples the main body 54 to the blowout device 60. In certain embodiments, the hose 62 may have an inner diameter (ID) of between approximately 1.0 to 2.0 inches. For example, in some embodiments, the hose 62 may have an ID of approximately 1.25 inches. The hose 62 may be a flexible hose to enable the main body 54 to move relative to the blowout device 60. For example, a vertical position of the main body 54 may be modified by moving a support 64 of the main body 54 within a bracket 66. By having a flexible hose, the hose 62 maintains a connection between the main body 54 and the blowout device 60 while the vertical position of the main body 54 changes. A height adjustment device 68 (e.g., knob) may be used to secure the support 64 to the bracket 66 to maintain a desired vertical position of the main body 54. As may be appreciated, the vertical position of the main body 54 may be modified based at least partly on a size of bottles being moved by the conveyor belt 52.

In the illustrated embodiment, the system 10 includes a pair of air knives 70 configured to direct air toward the application 48, such as to further dry containers on the conveyor belt 52. Other embodiments may include 0, 1, 2, 3, 4, or more air knives 70. In some embodiments, bottles are filled with a liquid, such as a beverage. The bottles are washed and the conveyor belt 52 transports the bottles in a direction 72 through the air manifold 14A, where the caps of the bottles are dried. As illustrated, the conveyor belt 52 includes legs 74 to support the conveyor belt 52 and the air manifold 14A.

By using the air manifold 14A described herein, air may be directed toward containers, such as bottles and/or caps of bottles, to dry a liquid found thereon. Moreover, the arms 56 may be disposed in a fixed position, such as by constructing the arms 56 from metal so they are not moveable relative to the main body 54. Furthermore, by constructing the arms 56 from metal, longevity of the arms 56 may be greater than arms 56 constructed from a plastic or polymeric material.

Figure 3:
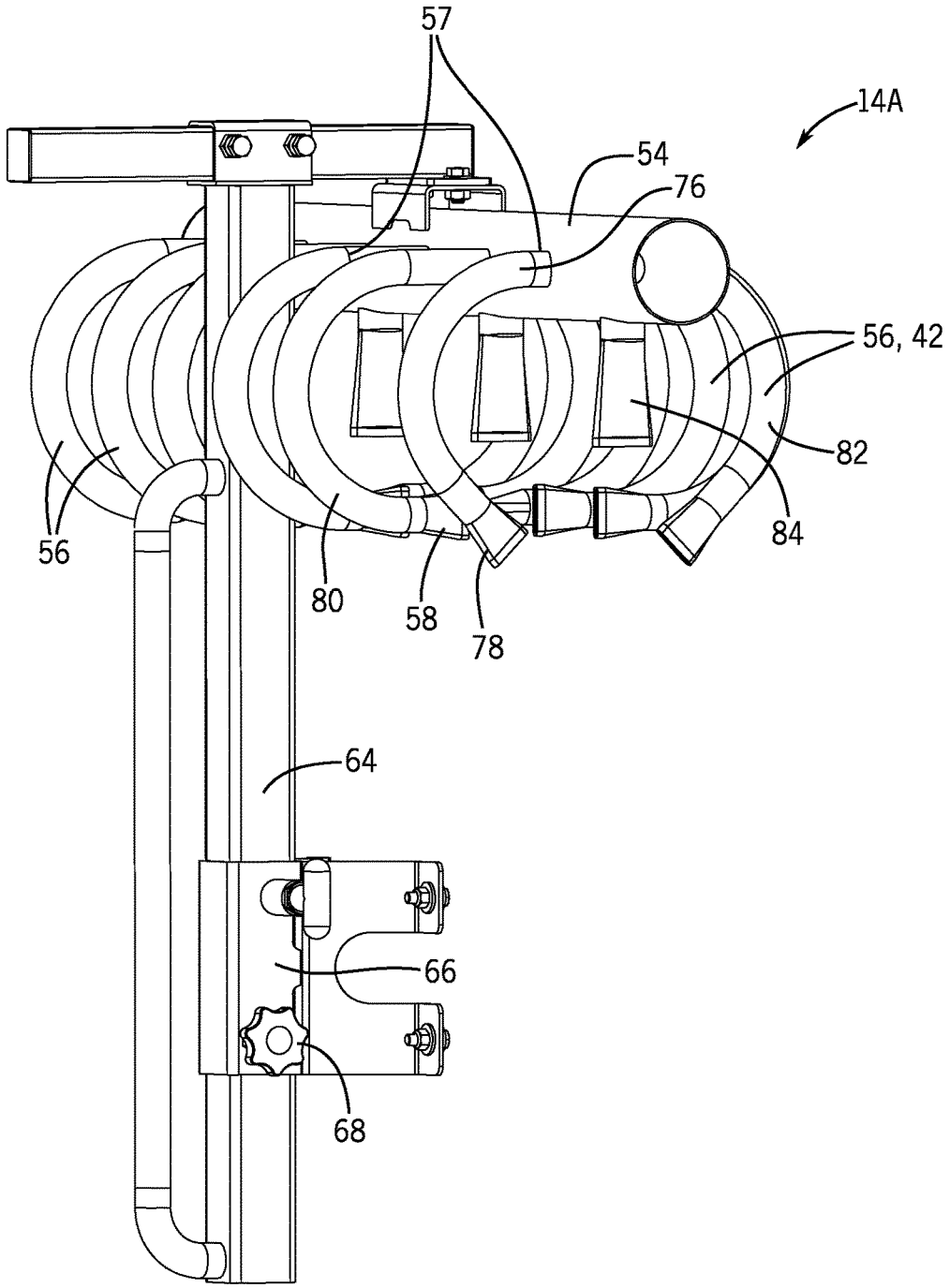
FIG. 3 is a perspective view of the air manifold of FIG. 2.

FIG. 3 is a perspective view of the air manifold 14A of FIG. 2. In certain embodiments, the main body 54 may be formed from a metal tube having an outer diameter (OD) of approximately between 2.0 to 4.0 inches. For example, in some embodiments, the main body 54 may be formed from a metal tube having an OD of approximately 3.0 inches. Each of the arms 56 may be formed from a tube having an OD of approximately between 0.75 to 1.5 inches. For example, in some embodiments, each arm 56 may be formed from a tube having an OD of approximately 1.0 inches. Moreover, the arms 56 each include a first end 76 that may be welded to the main body 54. Furthermore, the arms 56 each include a second end 78 that is flared. In certain embodiments, each of the arms 56 may be formed from a single tube bent to a desired angle and/or bent to have a flared end. For example, a first tube 80 may be bent to an arcuate shape having a first angle, a second tube 82 may be bent to an arcuate shape having a second angle, and a third tube 84 may be kept straight. In certain embodiments, the first tube 80 and/or the second tube 82 may be bent to form an arc between approximately 90 to 270 degrees, and having a radius between approximately 2.0 to 8.0 inches. For example, in one embodiment, the first tube 80 may be bent to form approximately a 180 degree arc having a 4.0 inch radius. Moreover, the second tube 82 may be bent to form approximately a 135 degree arc. The third tube 84 may extend substantially straight in the vertical direction. In other embodiments, the first tube 80, the second tube 82, and the third tube 84 may be bent to form any suitable arcuate shape.

The second end 78 of the first and second tubes 80 and 82 may be bent to be flared, with the flare having any suitable shape. In certain embodiments, the flared end may have an opening of between approximately 1.00 to 2.00 inches long and approximately 0.05 to 0.50 inches wide. For example, in some embodiments, the flared end may have an opening of approximately 1.30 inches long and approximately 0.125 inches wide. Moreover, the third tube 84 may substantially include a flared end. In certain embodiments, the third tube 84 may be formed from a tube having an OD of between approximately 1.00 to 2.00 inches. For example, in some embodiments, the third tube 84 may be formed from a tube having an OD of approximately 1.25 inches. Moreover, a flare of the third tube 84 may be approximately 1.7 inches long and approximately 0.125 inches wide. In other embodiments, the third tube 84 may be formed from a tube having an OD of approximately 1.0 inches, and/or may be flared or round.

As may be appreciated, the air manifold 14A with the arms 56 may be lightweight as compared to other air manifolds 14A. As described herein, the arms 56 may be formed from a single tube, thereby reducing manufacturing time by having a single welded connection between each arm 56 and the main body 54, and no other device attached to the single tube. Furthermore, airflow through each arm 56 may be enhanced by using the single tube with only one welded connection, thereby reducing the seams of the arms 56.

Figure 4:
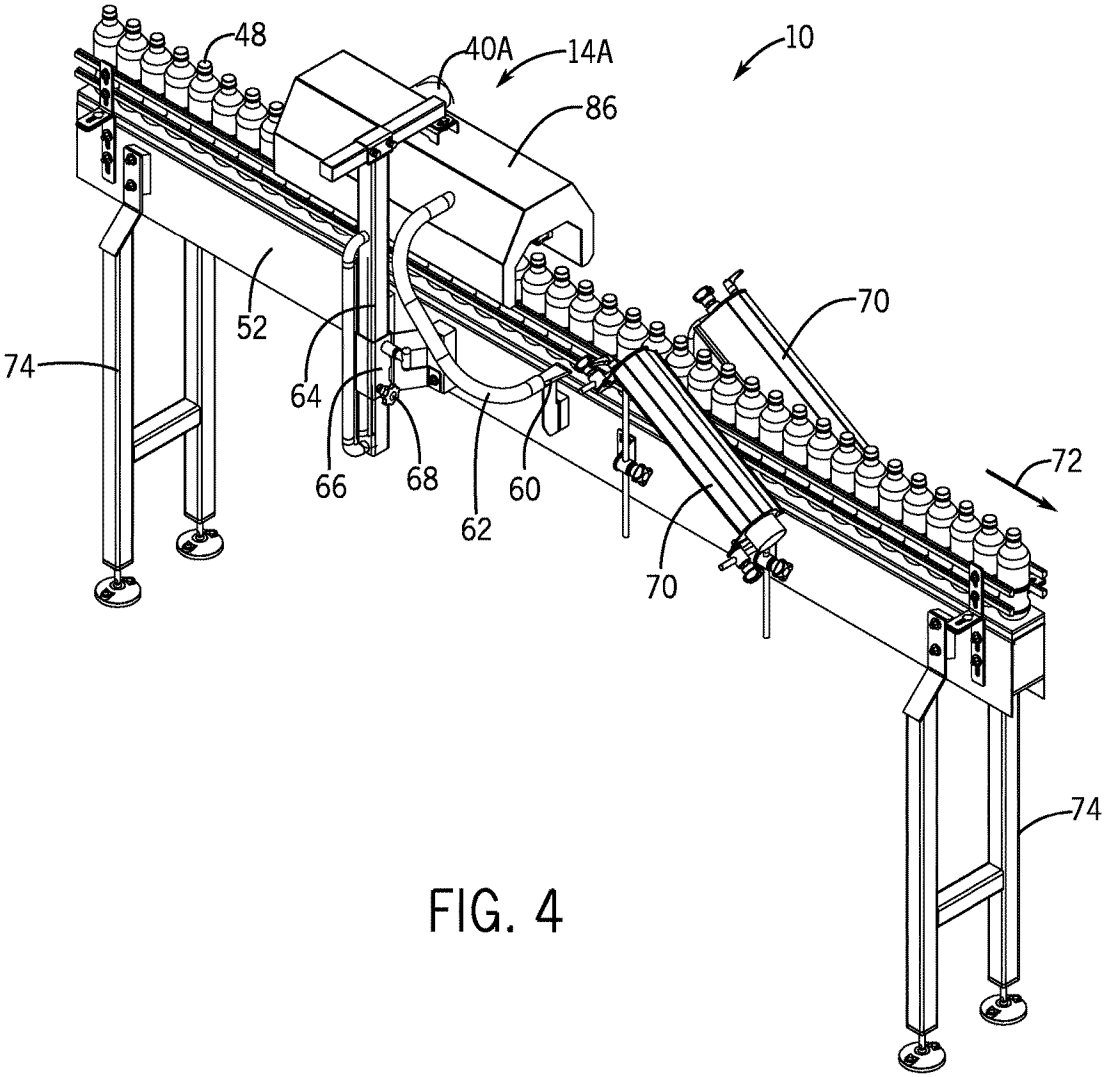
FIG. 4 is a perspective view of another embodiment of an air manifold having air delivery conduits disposed in a fixed position.

FIG. 4 is a perspective view of an embodiment of the air manifold 14A having the air delivery conduits 42 disposed in a fixed position. As illustrated, the air manifold 14A includes a main body 86 configured to receive air from the air supply source 12 and to provide the air to air delivery conduits 42. In certain embodiments, the main body 86 may be a hollow box formed from sheet metal that is bent to a desired shape and welded together. As may be appreciated, the u-shape of the main body 86 facilitates blocking fluid that is sprayed off of containers from contacting operators and/or the u-shape of the main body 86 facilitates containing fluid that is sprayed off of containers within the underside of the main body 86.

Figure 5:
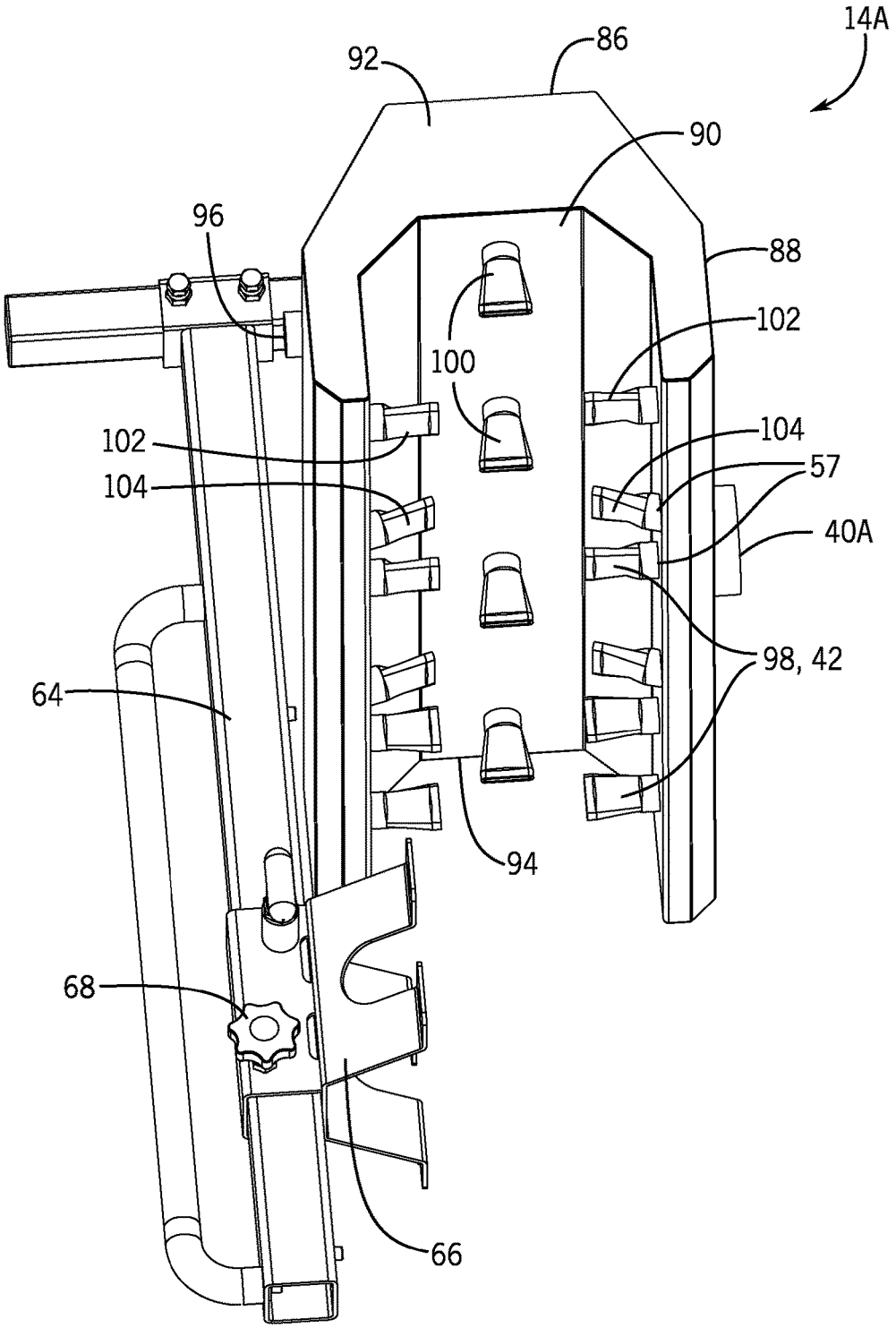
FIG. 5 is a perspective view of the air manifold of FIG. 4.

FIG. 5 is a perspective view of the air manifold 14A of FIG. 4. The main body 86 includes an external shell 88, an internal shell 90, and end pieces 92 and 94. In certain embodiments, the external shell 88 and the internal shell 90 may be bent to a desired shape, such as the shape illustrated. Collectively, the external shell 88, the internal shell 90, and the end pieces 92 and 94 may be welded together to form the main body 86. The main body 86 is configured to receive air at the inlet 40A from the air source supply 12. Moreover, the main body 86 provides air through outlets 57 to the air delivery conduits 42. Furthermore, the main body 86 includes an outlet 96 for providing air to the blowout device 60.

The main body 86 forms a plenum around arms 98 that extend inwardly from the main body 86. The plenum acts as a hood and may block water from spraying vertically toward the application 48. In certain embodiments, the arms 98 may be formed from a metal tube having an OD of between approximately 0.7 to 1.5 inches. For example, in some embodiments, the arms 98 may be formed from a metal tube having an OD of approximately 1.0 inches. Moreover, the metal tube may be between approximately 1.0 to 3.0 inches long. For example, the metal tube may be approximately 2.0 inches long. Furthermore, a flared end may be formed at one end of each of the arms 98. In certain embodiments, the flared end may have an opening of between approximately 1.00 to 2.00 inches long and approximately 0.05 to 0.50 inches wide. For example, in one embodiment, the arms 98 may include a flare having an opening of approximately 1.3 inches long and approximately 0.125 inches wide.

The arms 98 may extend inwardly from the main body 86 at a variety of different angles. For example, the arms 98 may extend in a substantially vertical direction as illustrated by first tubes 100, in a substantially horizontal direction as illustrated by second tubes 102, and/or at approximately 45 degrees as illustrated by third tubes 104. Furthermore, the arms 98 may extend inwardly from the main body 86 at any suitable angle. In certain embodiments, the air manifold 14A having the main body 86 may be between approximately 10 to 40 pounds. For example, in one embodiment, the air manifold 14A having the main body 86 may be approximately 25 pounds.

Figure 6:
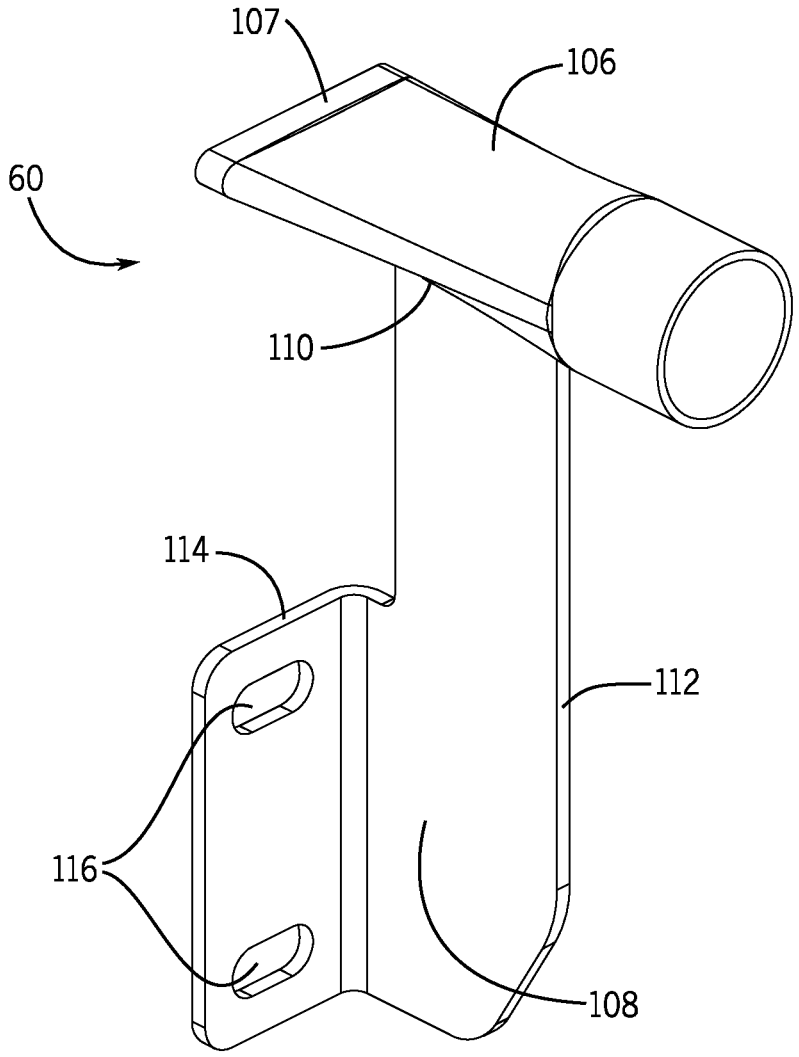
FIG. 6 is a perspective view of an embodiment of a blowout device.

FIG. 6 is a perspective view of an embodiment of the blowout device 60. The blowout device 60 includes a nozzle 106 having a flared end 107. The flared end 107 may be flared as discussed above, by bending a metal tube. Moreover, in certain embodiments, the flared end may have an opening of between approximately 1.00 to 2.00 inches long and approximately 0.05 to 0.50 inches wide. For example, in one embodiment, the blowout device 60 may have an opening of approximately 1.3 inches long and approximately 0.125 inches wide. A bracket 108 is coupled to the nozzle 106 at an end 110, such as by welding the end 110 to the nozzle 106. The bracket 108 includes a portion 108 coupled to the nozzle 106, and a mounting portion 114 having openings 116 for mounting the bracket 108 to a manufacturing device, such as to the conveyor belt 52. As discussed above, the blowout device 60 may be used to direct air toward the conveyor belt 52 to blow empty containers off the conveyor belt 52.

Figure 7:
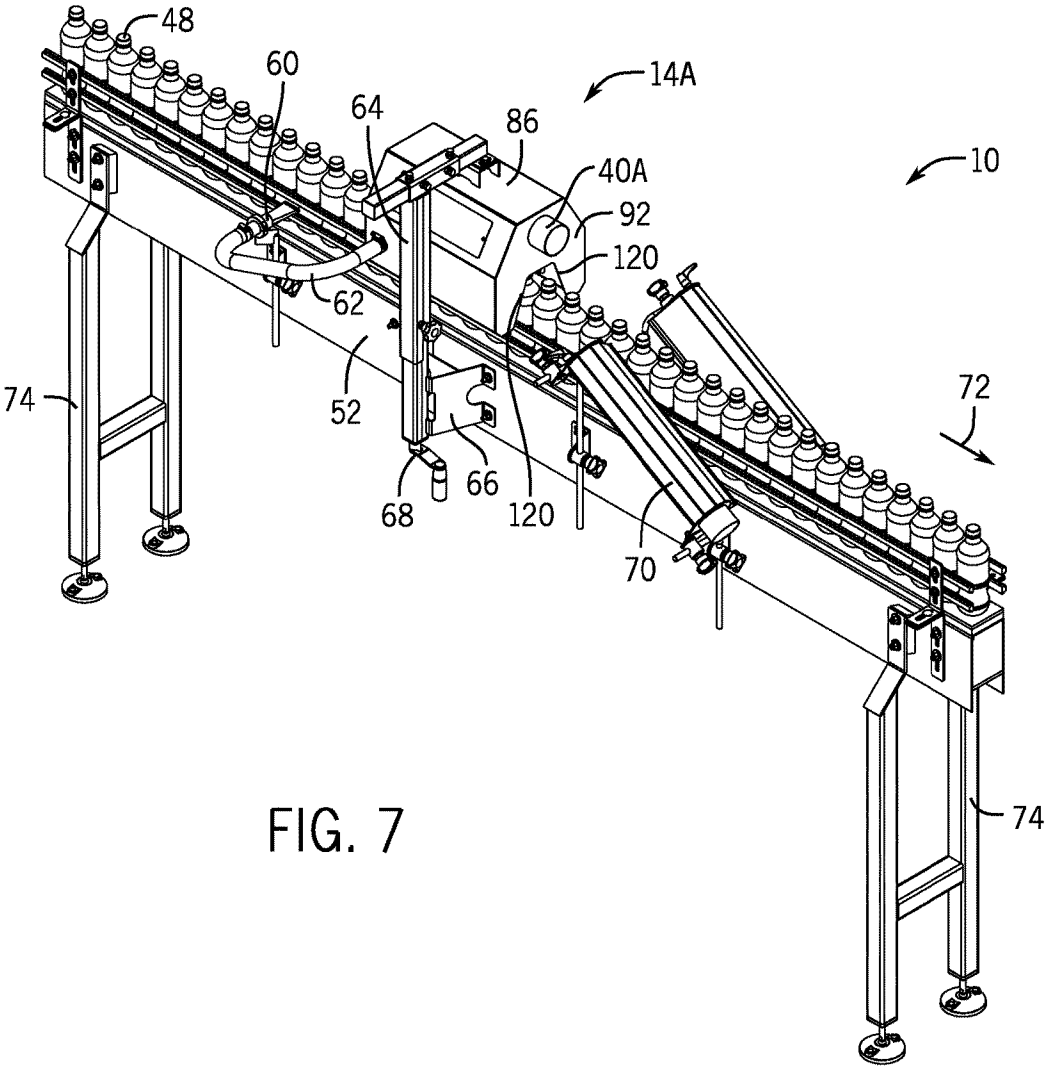
FIG. 7 is a perspective view of another embodiment of an air manifold having air delivery conduits disposed in a fixed position.

FIG. 7 is a perspective view of another embodiment of the air manifold 14A having the air delivery conduits 42 disposed in a fixed position. As illustrated, the air manifold 14A includes the main body 86 configured to receive air from the air supply source 12 via the inlet 40A on the end piece 92 and to provide the air to air delivery conduits 42. In certain embodiments, the main body 86 may be a hollow box formed from sheet metal that is bent to a desired shape and welded together. As illustrated, the end piece 92 includes slots 120 to operate as a sight line to facilitate height adjustment of the main body 86 relative to a bottle. As may be appreciated, the slots 120 may also be disposed on the end piece 94 of the main body 86. The height adjustment device 68 in the illustrated embodiment is a hand crank that may be used to maintain a desired vertical position of the main body 54. The hand crank enables the main body 54 to be adjusted with little effort. As may be appreciated, the vertical position of the main body 54 may be modified based at least partly on a size of bottles being moved by the conveyor belt 52.

Figure 8:
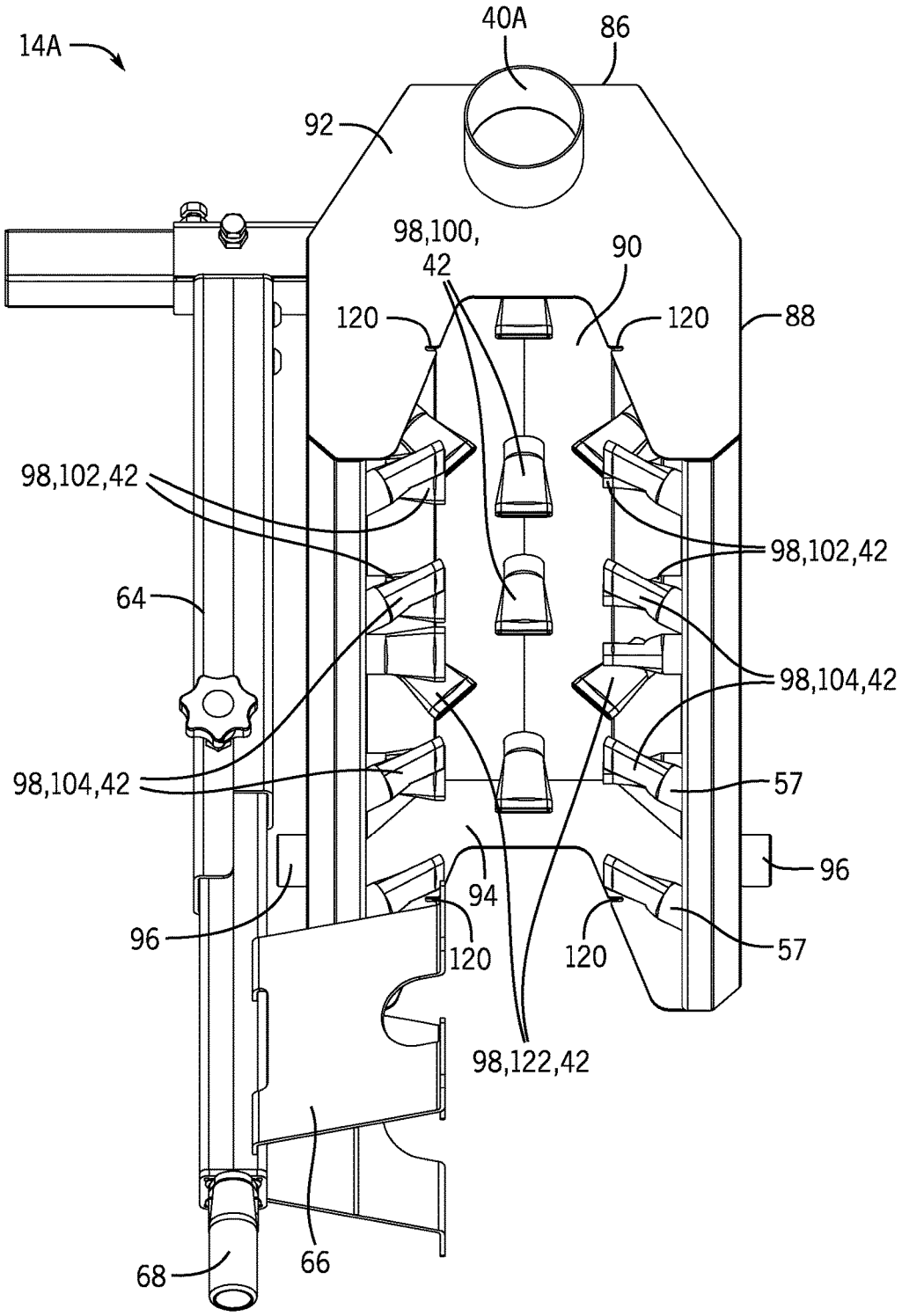
FIG. 8 is a perspective view of the air manifold of FIG. 7.

FIG. 8 is a perspective view of the air manifold 14A of FIG. 7. The main body 86 includes the external shell 88, the internal shell 90, and the end pieces 92 and 94. In certain embodiments, the external shell 88 and the internal shell 90 may be bent to a desired shape, such as the shape illustrated. Collectively, the external shell 88, the internal shell 90, and the end pieces 92 and 94 may be welded together to form the main body 86. The main body 86 is configured to receive air at the inlet 40A from the air source supply 12. Moreover, the main body 86 provides air through outlets 57 to the air delivery conduits 42. Furthermore, the main body 86 includes two outlets 96 for selectively providing air to the blowout device 60 from either the left or the right side of the main body 86. Thus, the main body 86 may be used for either a left or a right orientation. The OD of the outlets 96 may be between approximately 1.0 to 1.5 inches. For example, in some embodiments, the OD of the outlets 96 may be approximately 1.30 inches. Furthermore, the outlets 96 may be formed from half couplings having 0.75 inch female threads. Accordingly, if one or both of the outlets 96 are not used, the unused outlets 96 may be plugged with a pipe plug (e.g., plastic pipe plug).

The main body 86 forms a plenum around arms 98 that extend inwardly from the main body 86. The plenum acts as a hood and may block water from spraying vertically toward the application 48. In certain embodiments, the arms 98 may be formed from a metal tube having an OD of between approximately 0.7 to 1.5 inches. For example, in some embodiments, the arms 98 may be formed from a metal tube having an OD of approximately 1.0 inches. Moreover, the metal tube may be between approximately 1.0 to 3.0 inches long. For example, the metal tube may be approximately 2.0 inches long. Furthermore, a flared end may be formed at one end of each of the arms 98. In certain embodiments, the flared end may have an opening of between approximately 1.00 to 2.00 inches long and approximately 0.05 to 0.50 inches wide. For example, in one embodiment, the arms 98 may include a flare having an opening of approximately 1.3 inches long and approximately 0.125 inches wide.

The arms 98 may extend inwardly from the main body 86 at a variety of different angles. For example, the arms 98 may extend in a substantially vertical direction as illustrated by the first tubes 100, in a substantially horizontal direction as illustrated by the second tubes 102, and/or at approximately 45 degrees as illustrated by the third tubes 104 and fourth tubes 122. Furthermore, the arms 98 may extend inwardly from the main body 86 at any suitable angle. The air manifold 14A may include any suitable number of arms 98, such as the 24 arms 98 in the illustrated embodiment. Moreover, in some embodiments, the air manifold 14A may include less than 8, 10, 12, 14, 16, 18, 20, or 22 arms 98, or the air manifold 14A may include more than 24 arms 98. In certain embodiments, the air manifold 14A having the main body 86 may be between approximately 10 to 40 pounds. For example, in one embodiment, the air manifold 14A having the main body 86 may be approximately 25 pounds.

Figure 9:
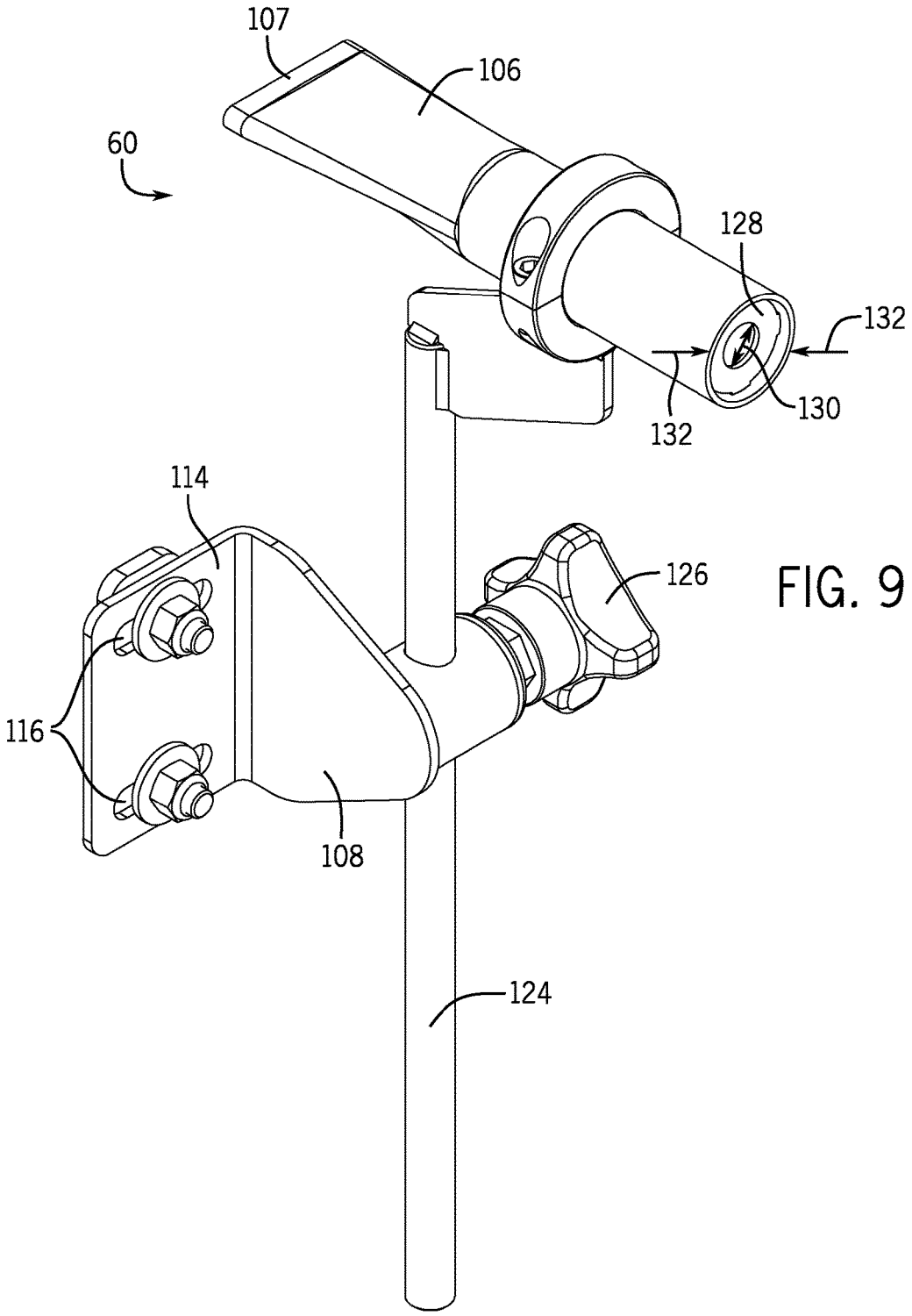
FIG. 9 is a perspective view of another embodiment of a blowout device.

FIG. 9 is a perspective view of an embodiment of the blowout device 60. The blowout device 60 includes the nozzle 106 having the flared end 107. The flared end 107 may be flared as discussed above, by bending a metal tube. Moreover, in certain embodiments, the flared end may have an opening of between approximately 1.00 to 2.00 inches long and approximately 0.05 to 0.50 inches wide. For example, in one embodiment, the blowout device 60 may have an opening of approximately 1.3 inches long and approximately 0.125 inches wide. The bracket 108 is coupled to the nozzle 106 using a tube 124 attached to the nozzle 106. The bracket 108 includes the mounting portion 114 having openings 116 for mounting the bracket 108 to a manufacturing device, such as to the conveyor belt 52. Also attached to the bracket 108 is an adjustment device 126 to enable vertical adjustment of the blowout device 60 relative to the conveyor belt 52. As discussed above, the blowout device 60 may be used to direct air toward the conveyor belt 52 to blow empty containers off the conveyor belt 52. In the illustrated embodiment, the blowout device 60 includes a restrictor plate 128 disposed therein. The restrictor plate 128 has an inner diameter 130 that is smaller than an inner diameter 132 of inlet tube of the blowout device 60. As such, the restrictor plate 128 is configured to decrease a flow rate of air flowing into the blowout device 60. By using the restrictor plate 128, energy may be conserved, and lighter force may be applied by the blowout device 60, such as while blowing air toward empty bottles.

As described herein, an air manifold 14A may be manufactured having arms in a fixed position relative to a main body of the air manifold 14A. The fixed position may be a calculated to efficiently dry caps on bottles of varying size. Moreover, the fixed position of the arms blocks movement of the arms relative to the main body of the air manifold 14A to maintain a consistent directional air flow output. Accordingly, while the air manifold 14A may be adjusted vertically, the arms of the air manifold 14A maintain a fixed position relative to the main body of the air manifold 14A. Thus, efficiency of the air manifold 14A is improved. Furthermore, the arms may be manufactured from a metal, such as stainless steel, thereby improving the longevity of the arms.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for drying a container comprising:

an air manifold comprising:

a main body having a plurality of outlets;

a plurality of arms, wherein the main body forms a plenum around the plurality of arms, the plenum configured as a hollow fluid cavity to supply air to the plurality of outlets, wherein each arm of the plurality of arms is configured to extend inwardly from the main body to direct air from a respective outlet of the plurality of outlets toward the container, each arm disposed in a fixed position relative to the main body, and wherein the plenum is configured as a hood to contain fluid sprayed off of the container within an underside of the main body; and a blowout device coupled to the main body, wherein the blowout device is configured to receive air from the main body from a blowout outlet of the plurality of outlets and to direct a stream of air received from the main body toward the container to displace the container from a conveying system if the container is empty; and a bracket coupled to the blowout device and to a conveyor belt frame of the conveying system, wherein the bracket is coupled to the blowout device at a first end of the bracket, and the bracket is coupled to the conveyer belt frame at a second end of the bracket.

2. The system of claim 1, wherein the air manifold comprises an inlet configured to receive air from an air supply.

3. The system of claim 1, wherein the main body has a hollow box shape.

4. The system of claim 1, wherein the main body is formed from sheet metal.

5. The system of claim 1, wherein each arm is welded to the respective outlet.

6. The system of claim 1, wherein each arm comprises a respective flared nozzle formed from metal, wherein a width of a first end of the flared nozzle is less than a length of the first end of the flared nozzle, and the width is perpendicular to the length across the first end.

7. The system of claim 6, wherein the flared nozzle is formed by bending a metal tube.

8. The system of claim 6, wherein each arm is formed together with the respective flared nozzle from a single tube.

9. The system of claim 6, wherein the width is between 2 to 40 times less than the length of the flared nozzle.

10. The system of claim 1, wherein the blowout device comprises a flared nozzle.

11. The system of claim 1, comprising a hose coupled between the blowout device and the main body.

12. The system of claim 1, comprising a height adjustment device configured to adjust the height of the air manifold.

13. The system of claim 1, wherein the bracket comprises an adjustment device configured to adjust a vertical position of the blowout device relative to the conveyor belt frame.

14. The system of claim 1, wherein the blowout device is configured to direct air toward the container in a single direction perpendicular to a direction of travel of the container along the conveying system to force the container from the conveying system.

15. The system of claim 1, wherein the bracket is rigidly coupled to the blowout device at the first end of the bracket, and the first end of the bracket is opposite the second end of the bracket.

16. A system for drying a container comprising: an air manifold comprising:

a main body having a plurality of outlets; and a plurality of arms, wherein the main body forms a plenum around the plurality of arms, the plenum configured as a hollow fluid cavity to supply air to the plurality of outlets, wherein each arm of the plurality of arms is configured to extend inwardly from the main body to direct air from a respective outlet of the plurality of outlets toward the container, each arm disposed in a fixed position relative to the main body, and wherein the plenum is configured as a hood to contain fluid sprayed off of the container within an underside of the main body, a blowout device coupled to the main body, wherein the blowout device is configured to receive air from the main body from a blowout outlet of the plurality of outlets and to direct a stream of air received from the main body toward the container to displace the container from a conveying system if the container is empty; and a bracket coupled to the blowout device and to a conveyor belt frame of the conveying system, wherein the bracket is coupled to the blowout device at a first end of the bracket, and the bracket is coupled to the conveyer belt frame at a second end of the bracket, wherein each arm is formed from a metal tube having a first end bent into a flared shape, and a second end welded to the respective outlet, wherein a width of the first end of the flared shape is less than a length of the first end of the flared shape, and the width is perpendicular to the length across the first end, and wherein the plurality of arms are configured to extend inwardly from the main body to direct air from a respective outlet of the plurality of outlets toward the container.

17. The system of claim 16, wherein the plurality of arms are configured to extend inwardly from the main body at a variety of different angles including substantially vertically, substantially horizontally, or at approximately a 45 degree angle.

18. A method comprising: forming a main body of an air manifold as a plenum around a plurality of arms, the plenum configured as a hollow fluid cavity to supply air to the plurality of outlets, wherein each arm extends inwardly from the main body toward a container, the plenum configured as a hood to contain fluid that is sprayed off of the container within an underside of the main body;

coupling a blowout device to a conveyor belt of the system in a fixed position with a bracket wherein the blowout device is configured to receive air from the main body from a blowout outlet of the plurality of outlets and to direct a stream of air received from the main body toward the container to displace the container from a conveying system if the container is empty;

bending a first end of a first metal tube to form a flared nozzle for an arm of the plurality of arms; and welding a second end of the first metal tube to an outlet of the main body, wherein a width of the first end of the flared nozzle is less than a length of the first end of the flared nozzle, and the width is perpendicular to the length across the first end.

19. The method of claim 18, comprising bending the first metal tube into an arcuate shape.

20. The method of claim 18, comprising forming the main body of the air manifold from sheet metal, wherein the main body comprises a hollow box substantially in a U-shape.

* * * * *